US011050158B2

(12) United States Patent
Nishida et al.

(10) Patent No.: US 11,050,158 B2
(45) Date of Patent: Jun. 29, 2021

(54) DIELECTRIC LENS

(71) Applicant: Murata Manufacturing Co., Ltd., Kyoto (JP)

(72) Inventors: Hiroshi Nishida, Kyoto (JP); Ryoichi Kubo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 9 days.

(21) Appl. No.: 16/728,578

(22) Filed: Dec. 27, 2019

(65) Prior Publication Data

US 2020/0136262 A1 Apr. 30, 2020

Related U.S. Application Data

(63) Continuation of application No. PCT/JP2018/022725, filed on Jun. 14, 2018.

(30) Foreign Application Priority Data

Jun. 30, 2017 (JP) ..... JP2017-128878

(51) Int. Cl.
*H01Q 15/08* (2006.01)
*H01Q 15/02* (2006.01)
*H01Q 21/20* (2006.01)

(52) U.S. Cl.
CPC ..... *H01Q 15/08* (2013.01); *H01Q 15/02* (2013.01); *H01Q 21/20* (2013.01)

(58) Field of Classification Search
CPC .... H01Q 15/08; H01Q 21/0031; H01Q 21/20; H01Q 15/02; H01Q 15/14
See application file for complete search history.

(56) References Cited

U.S. PATENT DOCUMENTS 6,313,802 B1 * 11/2001 Petersson ..... H01Q 15/04 343/753
8,860,607 B2 * 10/2014 Shamim ..... H01L 23/13 342/175
10,199,729 B2 * 2/2019 Matitsine ..... H01Q 21/205
10,256,551 B2 * 4/2019 Shehan ..... H01Q 25/00
(Continued)

FOREIGN PATENT DOCUMENTS

JP 2015-505182 A 2/2015
JP 2017-098743 A 6/2017
WO 2017/090401 A1 6/2017

OTHER PUBLICATIONS

International Search Report for International Application No. PCT/JP2018/022725 dated Aug. 28, 2018.
(Continued)

*Primary Examiner* — Vibol Tan
(74) *Attorney, Agent, or Firm* — Pearne & Gordon LLP

(57) ABSTRACT

A Luneburg antenna device includes a dielectric lens and an array antenna. The dielectric lens is a laminate of a plurality of disc members having distribution of permittivity varying with respect to its radial direction. Each of the disc members includes a planar section in which a thickness dimension of a radially outer area is smaller than a thickness dimension of a radially inner area and a fin section which extends in a radial manner from a central portion of the planar section toward a radially outer side and in which a radially inner area and a radially outer area have the same thickness dimension.

3 Claims, 12 Drawing Sheets

(56) References Cited

U.S. PATENT DOCUMENTS

| | | | | |
|---|---|---|---|---|
| 10,468,777 | B2 * | 11/2019 | Kawahata | H01Q 5/35 |
| 10,580,611 | B2 * | 3/2020 | Andreev | B22F 5/106 |
| 10,777,902 | B2 * | 9/2020 | Kawahata | H01Q 21/28 |
| 2015/0002352 | A1 | 1/2015 | Merlet et al. | |

OTHER PUBLICATIONS

Written Opinion for International Application No. PCT/JP2018/022725 dated Aug. 28, 2018.

Rondineau, Sebastien, et al., "A Sliced Spherical Lüneburg Lens", IEEE Antennas and Wireless Propagation Letters, vol. 2, Feb. 2003, pp. 163-166.

* cited by examiner

DIELECTRIC LENS

This is a continuation of International Application No. PCT/JP2018/022725 filed on Jun. 14, 2018 which claims priority from Japanese Patent Application No. 2017-128878 filed on Jun. 30, 2017. The contents of these applications are incorporated herein by reference in their entireties.

BACKGROUND

Technical Field

The present disclosure relates to a dielectric lens for concentrating high-frequency radio waves, such as millimeter waves.

A known example of a dielectric lens is formed of a laminate of a plurality of discs made of a dielectric material (see, for example, Non Patent Document 1). In the dielectric lens described in Non Patent Document 1, each of the discs has multiple holes, and the density of the holes in its radially outer area is higher than that in its radially inner area. Thus, the disc has permittivity distribution with respect to the radial direction.

Non Patent Document 1: S. Rondineau, M. Himidi, J. Sorieux, "A Sliced Spherical Luneburg Lens," IEEE Antennas and Wireless Propagation Letters, vol. 2, 2003

BRIEF SUMMARY

For the dielectric lens described in Non Patent Document 1, it is necessary to have, for example, several hundreds to several thousands of holes in the discs in order to obtain an appropriate permittivity distribution. If these holes are formed by drilling, the processing time is long, and resulting low productivity is a problem. Additionally, the density of the holes in the vicinity of the outer regions of the discs is high in order to reduce the permittivity on the outer side. Thus, if the discs are formed by, for example, injection molding, the large number of holes positioned in the outer regions hinder the flow of resin, and resulting difficulty in molding is a problem.

The present disclosure provides dielectric lenses excellent in mass-productivity.

To solve the above-described problems, the present disclosure is a dielectric lens including a laminate of a plurality of disc members, each of the disc members having distribution of permittivity varying with respect to a radial direction thereof. The disc member includes a planar section in which a thickness dimension of a radially outer area is smaller than a thickness dimension of a radially inner area and a fin section which extends in a radial manner from a central portion of the planar section toward a radially outer side and in which a radially inner area and a radially outer area have the same thickness dimension.

The present disclosure can provide dielectric lenses excellent in mass-productivity.

DETAILED DESCRIPTION

Figure 1:
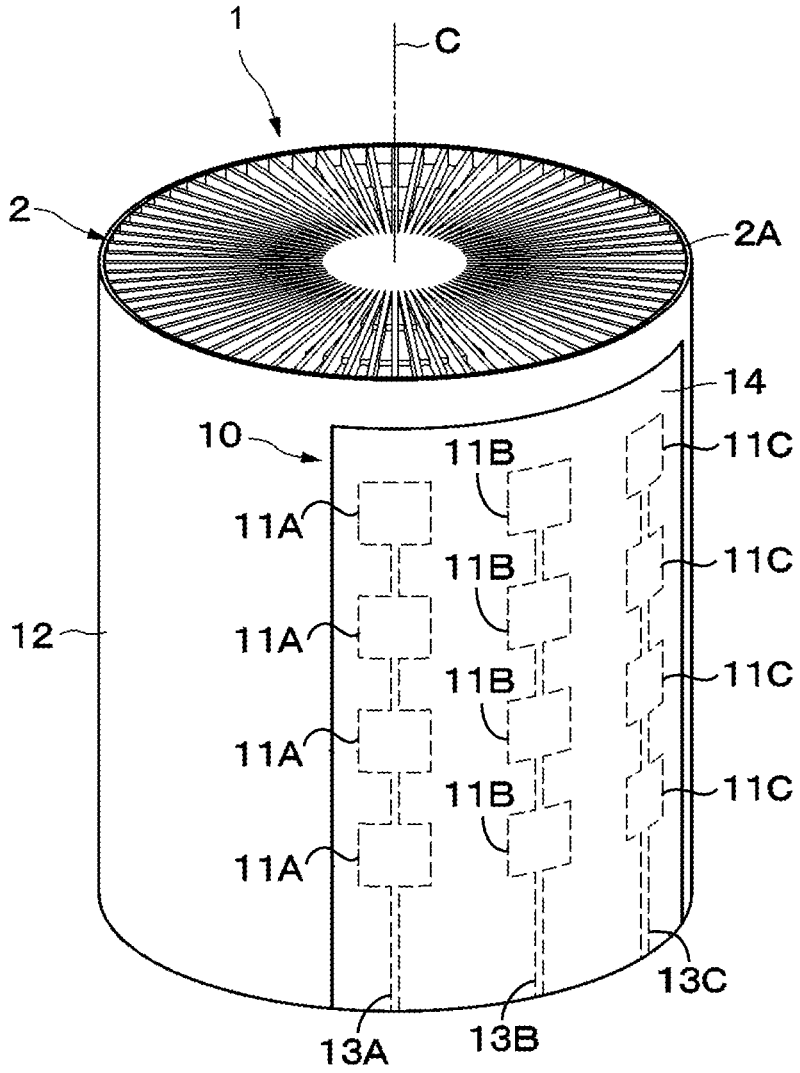
FIG. 1 is a perspective view that illustrates a Luneburg lens antenna device according to a first embodiment.

Dielectric lenses according to embodiments of the present disclosure are described in detail below with reference to accompanying drawings by using a case where they are applied to a Luneburg lens antenna device as an example.

FIGS. 1 to 10 illustrate a Luneburg lens antenna device 1 (hereinafter referred to as antenna device 1) according to a first embodiment. The antenna device 1 includes a dielectric lens 2 and an array antenna 10.

The dielectric lens 2 forms a cylindrical shape having distribution of permittivity varying with respect to the radial direction. As illustrated in FIGS. 3 to 7, the dielectric lens 2 is a laminate of a plurality of disc members 3 having the distribution of permittivity varying with respect to the radial direction. The disc members 3 are integrally formed from a resin material that allows injection molding and that has relative permittivity near two (e.g., polypropylene). The plurality of disc members 3 have the same outer diameter dimension and form a cylindrical laminate.

Figure 7:
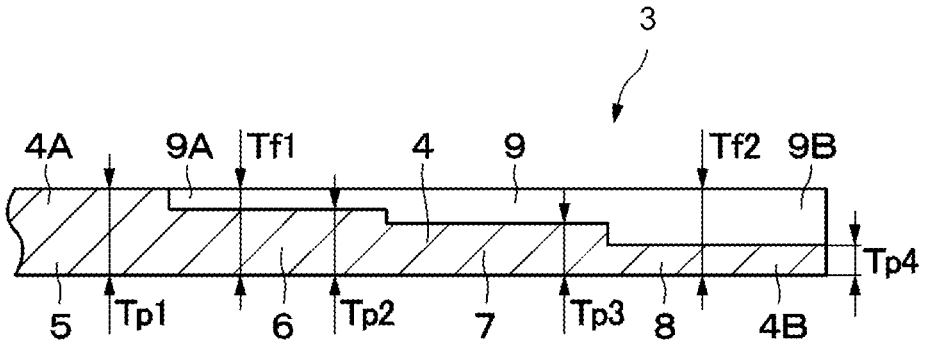
FIG. 7 is a cross-sectional view that illustrates an enlarged portion of the disc member in FIG. 6.

As illustrated in FIG. 7, each of the disc members 3 includes a planar section 4 and fin sections 9. In the planar section 4, a thickness dimension Tp4 of a radially outer area 4B is smaller than a thickness dimension Tp1 of a radially inner area 4A. The fin sections 9 extend in a radial manner from a central portion of the planar section 4 toward a radially outer side. In each of the fin sections 9, a thickness dimension Tf1 of a radially inner area 9A and a thickness dimension Tf2 of a radially outer area 9B are the same.

Specifically, the planar section 4 includes four disc areas 5 to 8 having different thickness dimensions Tp1 to Tp4, respectively. The disc areas 5 to 8 are concentrically arranged and positioned from the inner side toward the outer side in the radial direction, and their respective thickness dimensions Tp1 to Tp4 gradually decrease.

Thus, the first disc area 5 is the central area of the disc member 3, is positioned on the innermost side, and has the thickness dimension Tp1, which is the largest among the thickness dimensions of the disc areas 5 to 8. The second disc area 6 surrounds the first disc area 5 and is adjacent to the first disc area 5 on the radially outer side. The thickness dimension Tp2 of the second disc area 6 is smaller than the thickness dimension Tp1 of the first disc area 5 (Tp2<Tp1). The third disc area 7 surrounds the second disc area 6 and is adjacent to the second disc area 6 on the radially outer side. The thickness dimension Tp3 of the third disc area 7 is smaller than the thickness dimension Tp2 of the second disc area 6 (Tp3<Tp2). The fourth disc area 8 surrounds the third disc area 7 and is adjacent to the third disc area 7 on the radially outer side. The thickness dimension Tp4 of the fourth disc area 8 is smaller than the thickness dimension Tp3 of the third disc area 7 (Tp4<Tp3). The fourth disc area 8 is the outer edge area of the disc member 3, is positioned on the outermost side, and has the thickness dimension Tp4, which is the smallest among the thickness dimensions of the disc areas 5 to 8.

The back surfaces (bottom surfaces) of the disc areas 5 to 8 share a single flat surface. The front surfaces (top surfaces) of the disc areas 5 to 8 are different in height and are annular stepped surfaces.

The fin section 9 extends radially from the center of the planar section 4 (central axis C). The fin section 9 has a thin plate shape with a small width dimension and stands in the state where it protrudes from the front surfaces of the second to fourth disc areas 6 to 8. The thickness dimension of the fin section 9 is fixed over the full length in the radial direction. Thus, a thickness dimension Tf1 of the radially inner area 9A and a thickness dimension Tf2 of the radially outer area 9B in the fin section 9 are the same value. In addition, the thickness dimensions Tf1 and Tf2 of the fin section 9 are the same as the thickness dimension Tp1 of the radially inner area 4A in the planar section 4.

The dielectric lens 2 has a cylindrical shape formed by a laminate of the plurality of disc members 3. Of the two neighboring disc members 3 in the axial direction, the projecting ends of the fin sections 9 in one of the disc members 3 are in contact with the bottom surface of the other disc member 3. Thus, gaps are present in the radially outer area 4B of the planar section 4 between the two disc members 3. The dimension of each of the gaps with respect to the thickness dimension in the radially outer area 4B is larger than that in the radially inner area 4A. Accordingly, in the dielectric lens 2, the dielectric density reduces and the effective permittivity decreases toward the outer region. Therefore, by appropriately adjusting the thickness dimensions and the sizes of the disc areas 5 to 8 in the radial direction, the dielectric lens 2 has permittivity distribution that approximates Equation 1 (distribution of effective relative permittivity $\varepsilon_{r,eff}(r)$), where r is the radius dimension. Consequently, the dielectric lens 2 operates as a Luneburg lens (lens for radio waves). Thus, the dielectric lens 2 has a plurality of focal points at different positions in the circumferential direction on its outer surface side with respect to an electromagnetic wave of a predetermined frequency.

$$\varepsilon_{r_eff}(r) = 2 - \left(\frac{r}{R}\right)^2 \quad \text{[Equation 1]}$$

where r≤R

R: disc radius

The array antenna 10 includes a plurality of (e.g., 12) patch antennas 11A to 11C, feeding electrodes 13A to 13C, and a ground electrode 14.

The 12 patch antennas 11A to 11C are attached to an outer surface 2A of the dielectric lens 2. These patch antennas 11A to 11C are arranged in a matrix (4 rows and 3 columns) at different positions in the circumferential direction and the axial direction. The patch antennas 11A to 11C may be made of, for example, a conductive film (metal film) having a rectangular shape expanding in the circumferential direction and the axial direction of the dielectric lens 2 and are connected to the feeding electrodes 13A to 13C. The patch antennas 11A to 11C function as antenna elements (radiating elements) by receiving high-frequency signals supplied from the feeding electrodes 13A to 13C. Thus, the patch antennas 11A to 11C can transmit or receive high-frequency signals of, for example, submillimeter waves or millimeter waves, depending on, for example, their lengths or dimensions.

The patch antennas 11A, patch antennas 11B, and patch antennas 11C are disposed in different columns and can transmit or receive high-frequency signals independently of each other. The patch antennas 11A to 11C may be arranged, for example, side by side and spaced uniformly in the circumferential direction.

Figure 8:
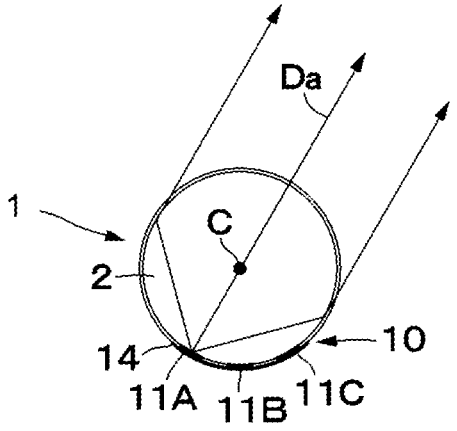
FIG. 8 is a diagram that illustrates a state where a beam is emitted from a patch antenna on a first side in a circumferential direction.
Figure 9:
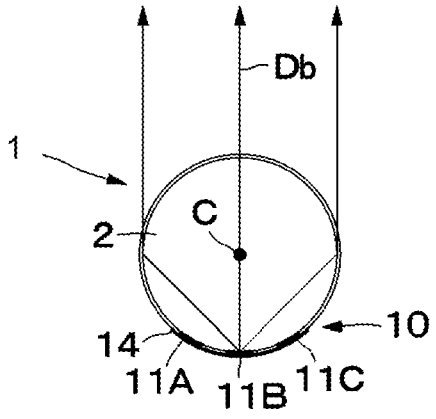
FIG. 9 is a diagram that illustrates a state where a beam is emitted from a patch antenna on a central side in the circumferential direction.
Figure 10:
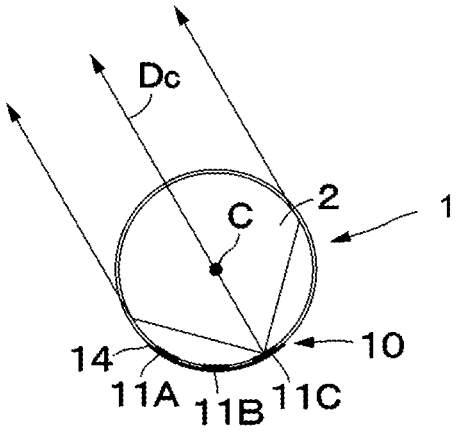
FIG. 10 is a diagram that illustrates a state where a beam is emitted from a patch antenna on a second side in the circumferential direction.

Thus, as illustrated in FIGS. 8 to 10, the patch antennas 11A to 11C form directional beams toward an opposite side beyond the central axis C of the dielectric lens 2. The patch antennas 11A to 11C are arranged at different positions in the circumferential direction of the dielectric lens 2. Thus, the radiating directions of the beams from the patch antennas 11A to 11C are different from each other.

Figure 2:
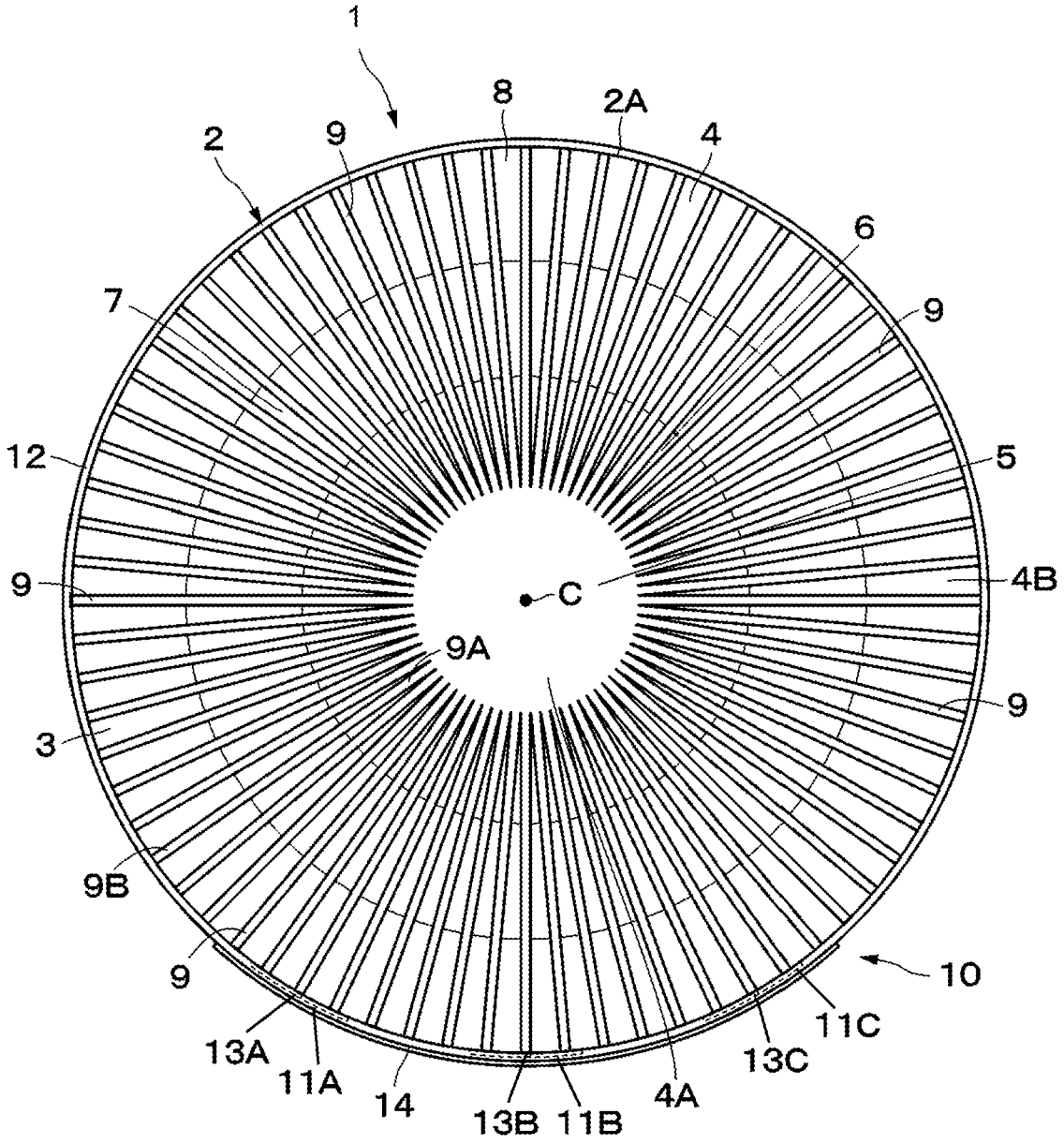
FIG. 2 is a plan view that illustrates the Luneburg lens antenna device in FIG. 1.
Figure 3:
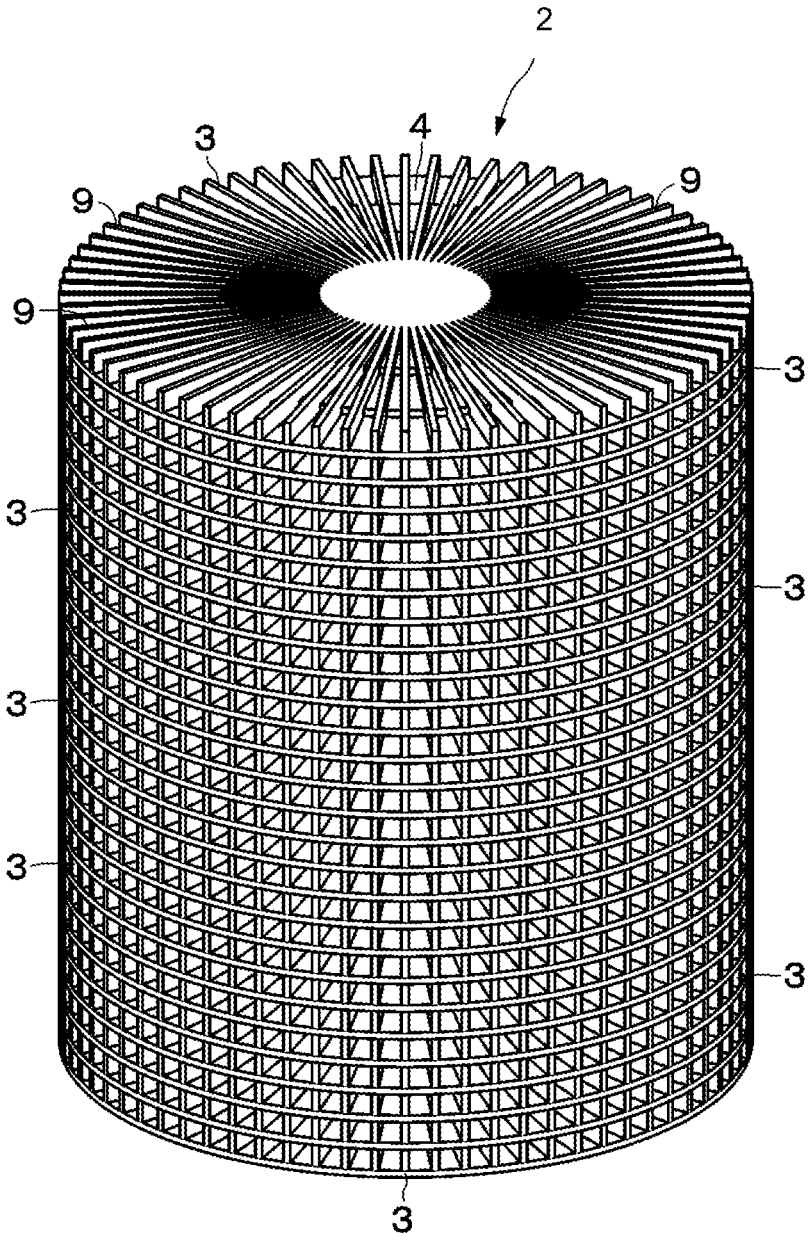
FIG. 3 is a perspective view that illustrates a dielectric lens in FIG. 1.
Figure 4:
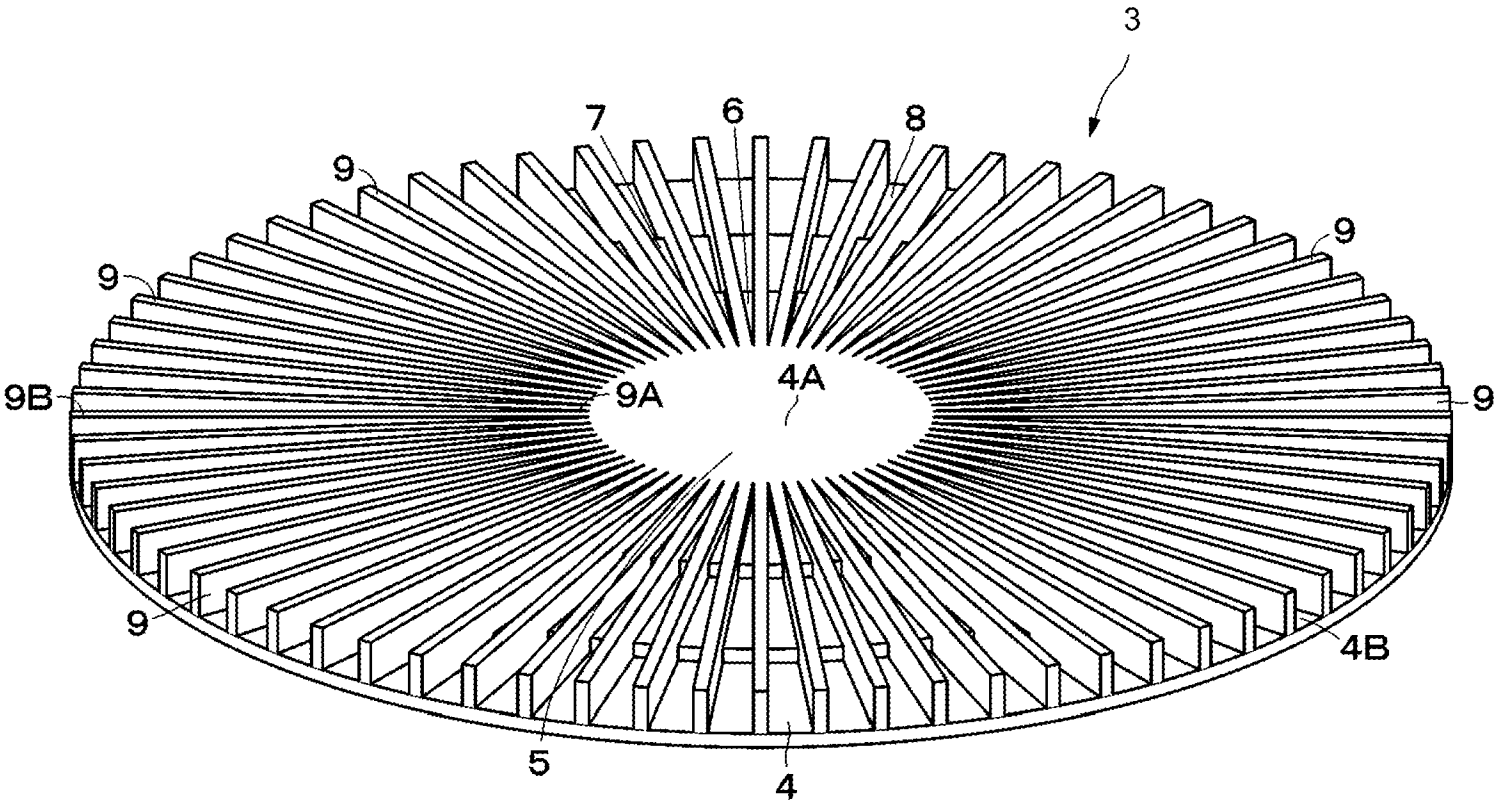
FIG. 4 is a perspective view that illustrates an enlarged disc member in FIG. 3.
Figure 5:
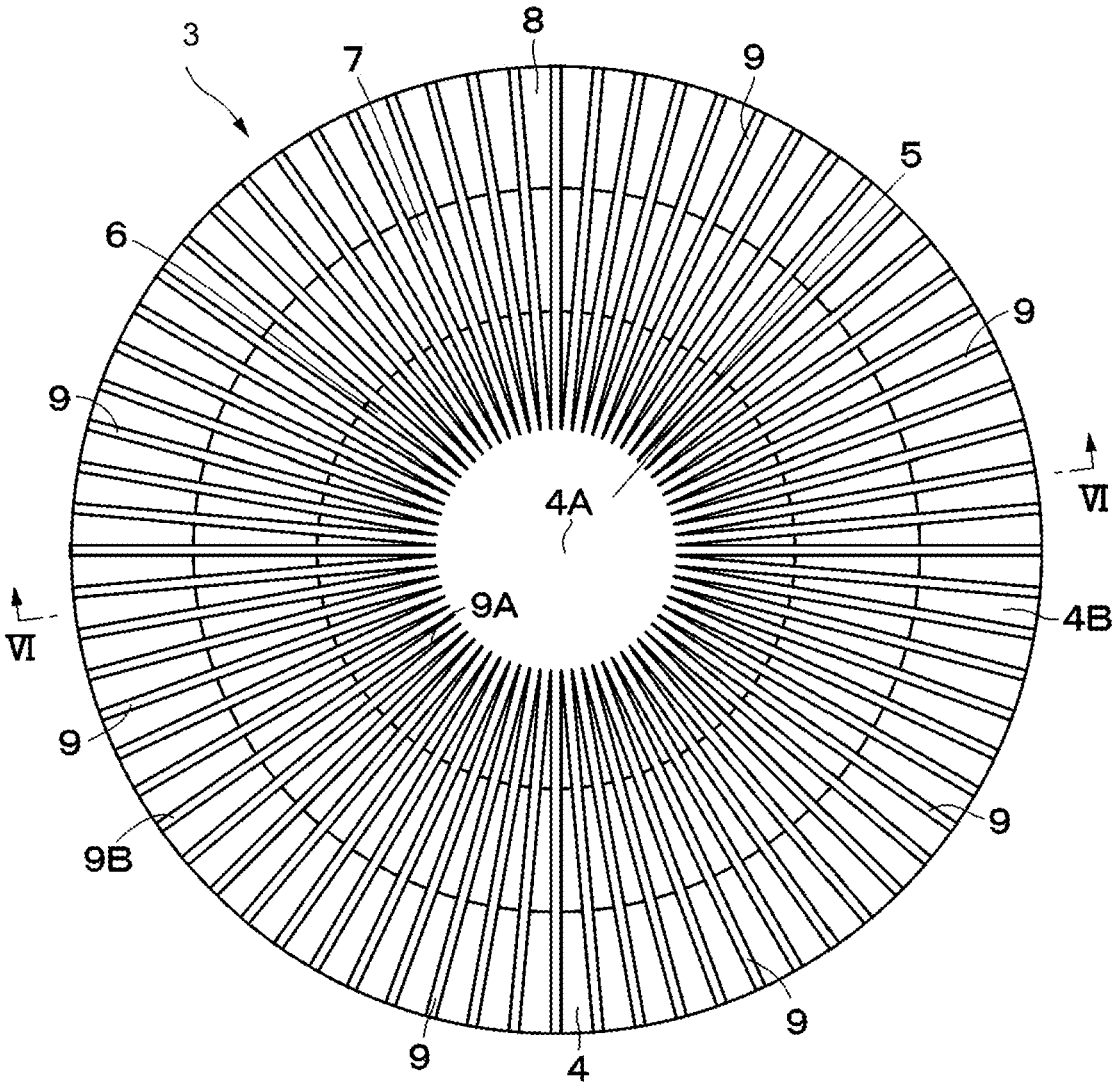
FIG. 5 is a plan view that illustrates the disc member in FIG. 4.
Figure 6:
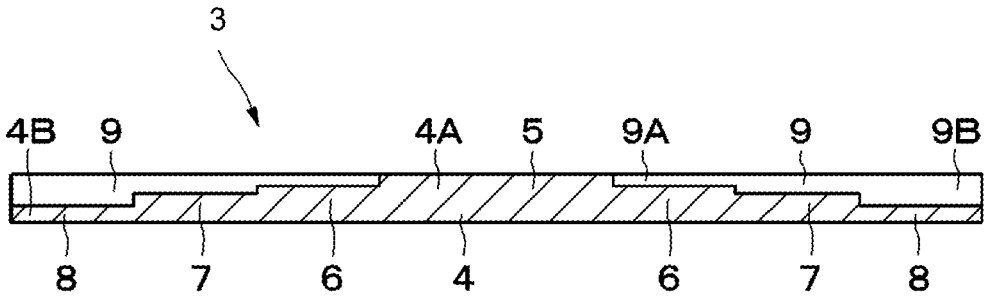
FIG. 6 is a cross-sectional view of the disc member viewed from a direction of the indication VI-VI with arrows in FIG. 5.

As illustrated in FIGS. 1 and 2, an insulating layer 12 covering all the patch antennas 11A to 11C is disposed on the outer surface 2A of the dielectric lens 2. The insulating layer 12 is formed of a tubular covering member and may include, for example, a bonding layer for closely bonding the patch antennas 11A to 11C to the outer surface 2A of the dielectric lens 2.

Each of the feeding electrodes 13A to 13C is formed of a long narrow conductive film. The feeding electrodes 13A to 13C are disposed on the outer surface 2A of the dielectric lens 2, together with the patch antennas 11A to 11C, and are covered with the insulating layer 12. The feeding electrode 13A axially extends along the four patch antennas 11A and are connected to the four patch antennas 11A. The feeding electrode 13B axially extends along the four patch antennas 11B and are connected to the four patch antennas 11B. The feeding electrode 13C axially extends along the four patch antennas 11C and are connected to the four patch antennas 11C. The base ends of the feeding electrodes 13A to 13C are connected to a transmission and reception circuit (not illustrated).

The ground electrode 14 is disposed on the outer surface of the insulating layer 12. The ground electrode 14 is formed of a rectangular conductive film (metal film) expanding in the circumferential direction and axial direction of the dielectric lens 2 and covers all the patch antennas 11A to 11C. The ground electrode 14 is connected to an external ground and is retained at a ground potential. Thus, the ground electrode 14 may be formed at an angular range of, for example, not larger than 90 degrees with respect to the central axis C of the dielectric lens 2 and functions as a reflector.

In the present embodiment, the case where the array antenna 10 uses the patch antennas 11A to 11C as antenna elements is described as an example. The antenna elements are not limited to the patch antennas. Another example may be a slot array antenna that uses slot antennas as antenna elements.

Next, actions of the antenna device 1 according to the present embodiment are described with reference to FIGS. 8 to 10.

When electricity is supplied from the feeding electrode 13A toward the patch antennas 11A, a current may flow through the patch antennas 11A, for example, in the axial direction. Thus, the patch antennas 11A emit high-frequency signals corresponding to the dimension in the axial direction toward the dielectric lens 2. Consequently, as illustrated in FIG. 8, the antenna device 1 can emit high-frequency signals (beams) toward a direction Da, which is opposite to the patch antennas 11A beyond the central axis C of the dielectric lens 2. The antenna device 1 can also receive high-frequency signals coming from the direction Da by using the patch antennas 11A.

Similarly, as illustrated in FIG. 9, when electricity is supplied from the feeding electrode 13B toward the patch antennas 11B, the antenna device 1 can transmit high-frequency signals toward a direction Db, which is opposite to the patch antennas 11B beyond the central axis C of the dielectric lens 2, and can also receive high-frequency signals from the direction Db.

As illustrated in FIG. 10, when electricity is supplied from the feeding electrode 13C toward the patch antennas 11C, the antenna device 1 can transmit high-frequency signals toward a direction Dc, which is opposite to the patch antennas 11C beyond the central axis C of the dielectric lens 2, and can also receive high-frequency signals from the direction Dc.

The above-described example is the case where a current is made to flow in the patch antennas 11A to 11C in the axial direction and emit polarized electromagnetic waves parallel with the thickness direction of the disc member 3. The present disclosure is not limited to this example. The current may be made to flow in the patch antennas 11A to 11C in the circumferential direction, and the patch antennas 11A to 11C may emit polarized electromagnetic waves perpendicular to the thickness direction of the disc member 3 or emit circularly polarized waves.

Hence, in the first embodiment, the dielectric lens 2 is formed of the cylindrical laminate of the plurality of disc members 3. Each of the disc members 3 includes the planar section 4, in which the thickness dimension of the radially outer area 4B is smaller than that of the radially inner area 4A, and the fin sections 9. The fin sections 9 extend in a radial manner from the central portion of the planar section 4 toward the radially outer side. In each of the fin sections 9, the radially inner area 9A and radially outer area 9B have the same thickness dimension.

Of the two neighboring disc members 3 in the axial direction, the projecting ends of the fin sections 9 in one of the disc members 3 are in contact with the bottom surface of the other disc member 3. Thus, gaps are present in the radially outer area 4B of the planar section 4 between the two disc members 3. The dimension of each of the gaps with respect to the thickness dimension in the radially outer area 4B is larger than that in the radially inner area 4A. Consequently, because the effective permittivity on the radially outer side is lower than that on the radially inner side in the dielectric lens 2, in which the plurality of disc members 3 are laminated, the dielectric lens 2 operates as a Luneburg lens.

Figure 11:
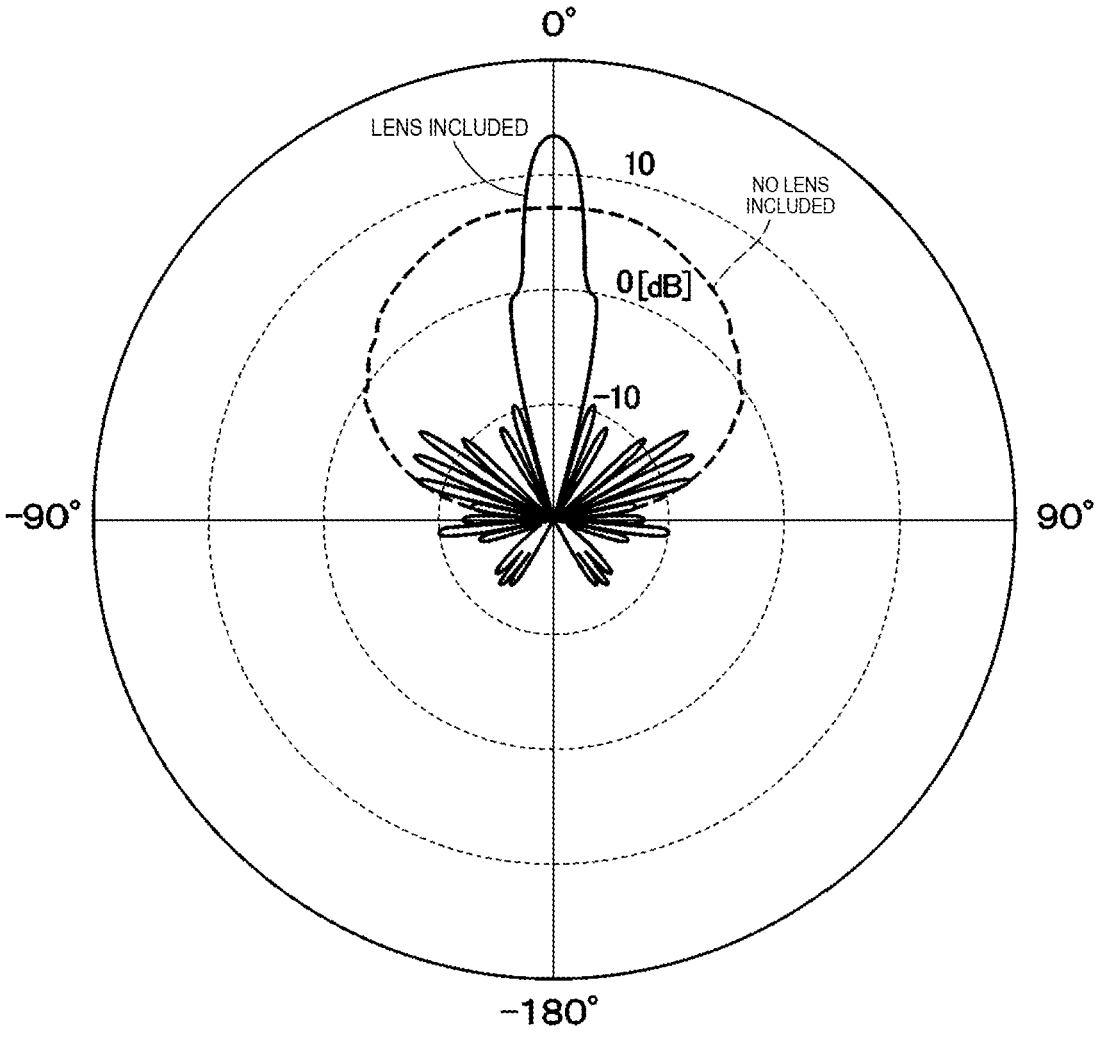
FIG. 11 is a radiating pattern diagram that illustrates a result of electromagnetic-field simulation of the Luneburg lens antenna device.

FIG. 11 illustrates a result of electromagnetic-field simulation calculated on the configuration with a lens whose radius is 15 mm in the 79 GHz band. As illustrated in FIG. 11, when the dielectric lens 2 is used, the waveform of the directional beam of the antenna device 1 is narrower and the antenna gain is improved by about 7 dB, in comparison with the case where the dielectric lens 2 is not used.

Because the disc member 3 is composed of the planar section 4, which becomes thinner from the central portion toward the circumferential portion, and the fin sections 9, whose thicknesses are fixed, the structure of the disc member 3 can be easily formed by injection molding. Thus, the disc members 3 can be easily mass-produced, and the mass-productivity of the dielectric lenses 2 can be enhanced. Moreover, the plurality of disc members 3 have the same outer diameter dimension and form a cylindrical laminate. Thus, the cylindrical Luneburg lens can be formed.

Figure 12:
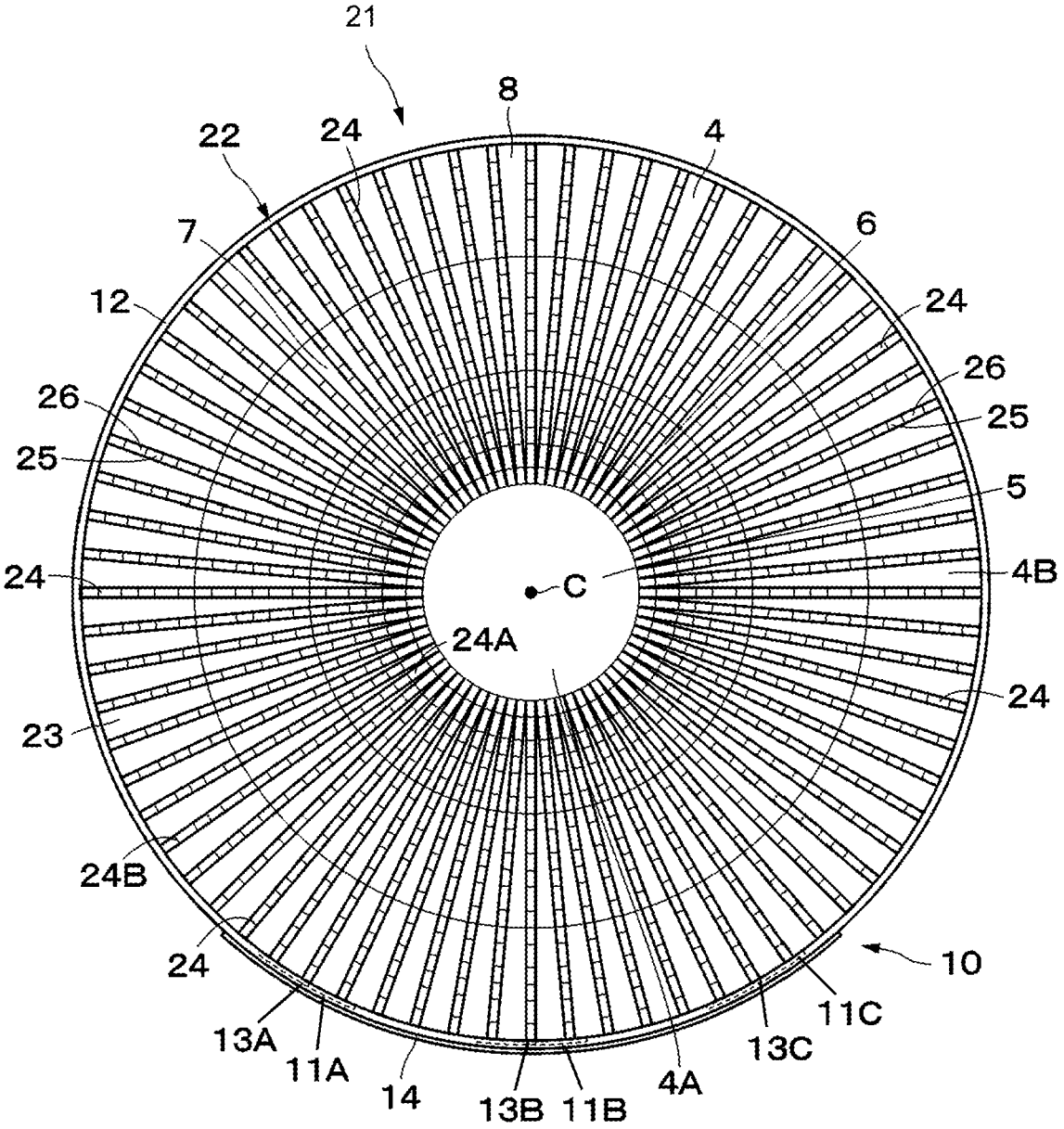
FIG. 12 is a plan view that illustrates a Luneburg lens antenna device according to a second embodiment.

Next, a Luneburg lens antenna device 21 (hereinafter referred to as antenna device 21) according to a second embodiment of the present disclosure is illustrated in FIG. 12. The second embodiment has the characteristics of the fin sections, each including a plurality of depressions positioned between the center and outer edge in the radial direction and having small thickness dimensions and a plurality of projections positioned other than the depressions and having large thickness dimensions. In the description about the antenna device 21, the same reference numerals are used in the same configuration as that in the antenna device 1 according to the first embodiment, and the description on that configuration is omitted.

The antenna device 21 according to the second embodiment is similar to the antenna device 1 according to the first embodiment. The antenna device 21 includes a dielectric lens 22 and the array antenna 10.

Figure 13:
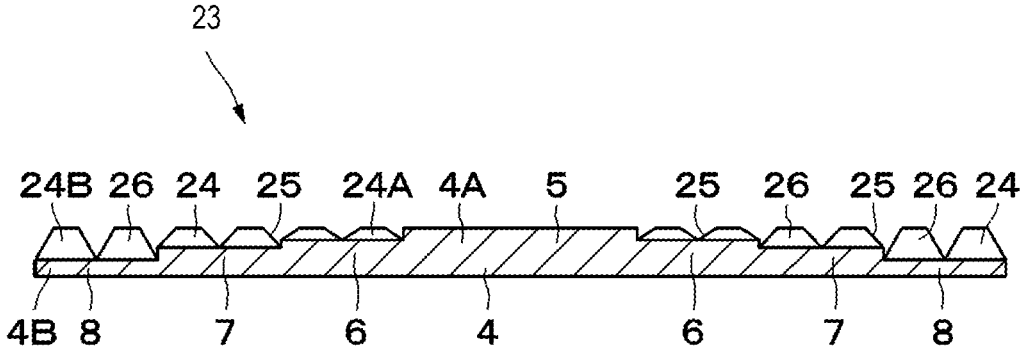
FIG. 13 is a cross-sectional view that illustrates a disc member according to the second embodiment at substantially the same position as that in FIG. 6.
Figure 14:
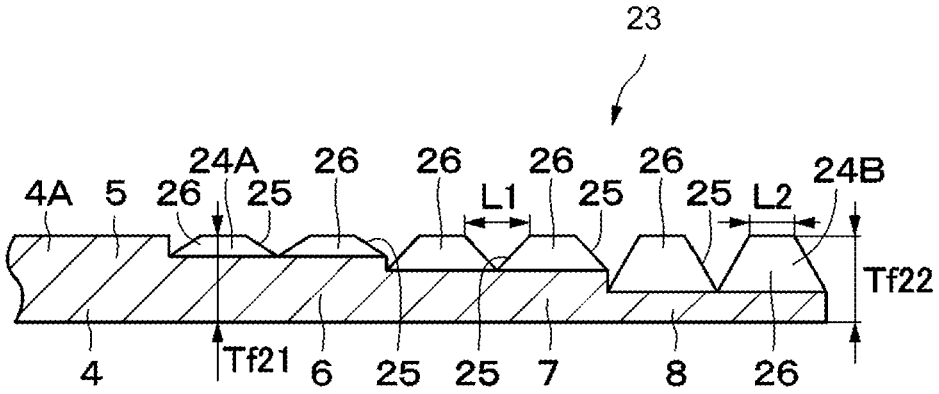
FIG. 14 is a cross-sectional view that illustrates an enlarged portion of the disc member in FIG. 13.

The dielectric lens 22 according to the second embodiment is formed of a laminate of a plurality of disc members 23 having distribution of permittivity varying with respect to the radial direction, as in the case of the dielectric lens 2 according to the first embodiment. As illustrated in FIGS. 13 and 14, each of the disc members 23 is similar to the disc member 3 according to the first embodiment. Thus, the disc member 23 includes the planar section 4, in which the thickness dimension of the radially outer area 4B is smaller than the thickness dimension of the radially inner area 4A, and fin sections 24 extending in a radial manner from the central portion of the planar section 4 toward the radial outer side. In each of the fin sections 24, a thickness dimension Tf21 of a radially inner area 24A and a thickness dimension Tf22 of a radially outer area 24B are the same.

The fin section 24 includes a plurality of depressions 25 positioned between the center and outer edge in the radial direction and having smaller thickness dimensions (i.e., a length from the bottom surface of the disc member 23 to a surface of the depressions 25) and a plurality of projections 26 positioned other than the depressions 25 and having larger thickness dimensions (i.e., a length from the bottom surface of the disc member 23 to a top surface of the projections 26). In this respect, the fin section 24 according to the second embodiment differs from the fin section 9 according to the first embodiment, whose thickness dimension is fixed over the full length in the radial direction. The depressions 25 slope to the projections 26 and have tapered shapes in which their thickness dimensions continuously increase toward the projections 26. Thus, the depressions 25 and projections 26 are smoothly connected to each other along the radial direction.

A length dimension L1 of the depression 25 in the radial direction is set at a value smaller than ¼ of a wavelength of high-frequency signals emitted from the patch antennas 11A to 11C as a radio wave to be used. A length dimension L2 of the projection 26 in the radial direction is set at a value smaller than ¼ of the wavelength of the radio wave to be used. The length dimensions L1 of the plurality of depressions 25 are not necessarily the same and may be different values. Similarly, the length dimensions L2 of the plurality of projections 26 are not necessarily the same and may be different values.

Hence, the second embodiment can also obtain substantially the same operational advantages as in the first embodiment. The fin section 24 includes the plurality of depressions 25, which are positioned between the center and outer edge in the radial direction and have smaller thickness dimensions, and the plurality of projections 26, which are positioned other than the depressions 25 and have larger thickness dimensions. This can lead to a reduction in the difference between the effective permittivity of the dielectric lens 22 to a polarized wave parallel with the thickness direction of the disc member 23 and the effective permittivity of the dielectric lens 22 to a polarized wave perpendicular to the thickness direction of the disc member 23. Consequently, the effective permittivity can obtain desired distribution for not only the polarized wave parallel with the axis of the dielectric lens 22 but also the polarized wave perpendicular to the axis of the dielectric lens 22. Thus, the effective permittivity is easily controllable for a polarized wave perpendicular to the cylinder axis of the dielectric lens 22. Each of the length dimension L1 of the depression 25 in the radial direction and the length dimension L2 of the projection 26 in the radial direction is set at a value smaller than ¼ of the wavelength of a high-frequency signal. Thus, discontinuity between the depression 25 and projection 26 can be reduced with respect to the high-frequency signal.

Figure 15:
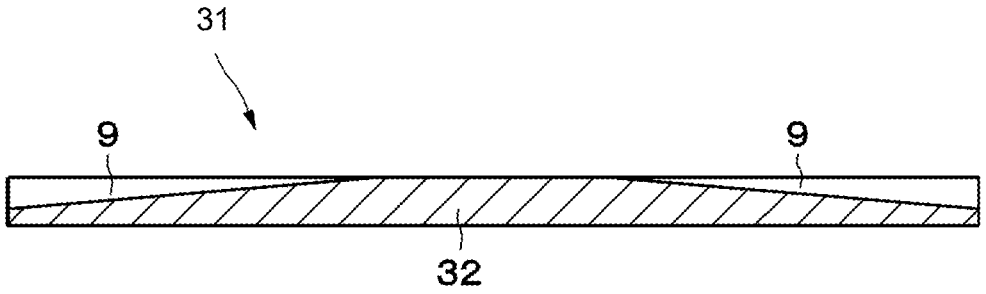
FIG. 15 is a cross-sectional view that illustrates a disc member according to a first variation at substantially the same position as that in FIG. 6.

In the above-described first embodiment, the disc member 3 includes the planar section 4, whose thickness dimension decreases in stages (in steps) with respect to the radial direction. The present disclosure is not limited to this configuration. As in a first variation illustrated in FIG. 15, a disc member 31 may include a planar section 32, whose thickness dimension continuously decreases with respect to the radial direction. This configuration is also applicable to the second embodiment.

Figure 16:
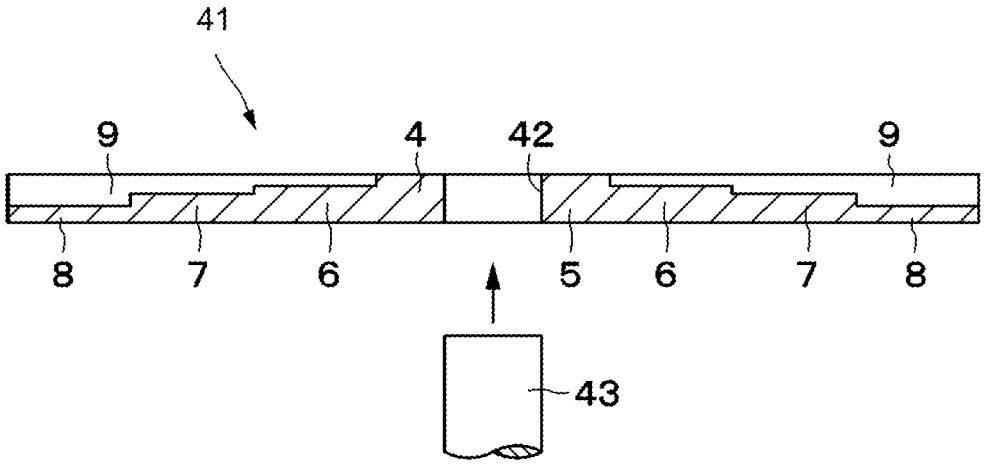
FIG. 16 is a cross-sectional view that illustrates a disc member according to a second variation at substantially the same position as that in FIG. 6.

As in a second variation illustrated in FIG. 16, a disc member 41 may have a through hole 42 at the center of the planar section 4. In this case, in the state where a plurality of disc members 41 are laminated, a core member 43 made of the same dielectric material as that of the planar section 4 is placed in the through holes 42. In this case, the centers of the plurality of disc members 41 can be easily aligned by the use of the core member 43. This configuration is also applicable to the second embodiment.

Figure 17:
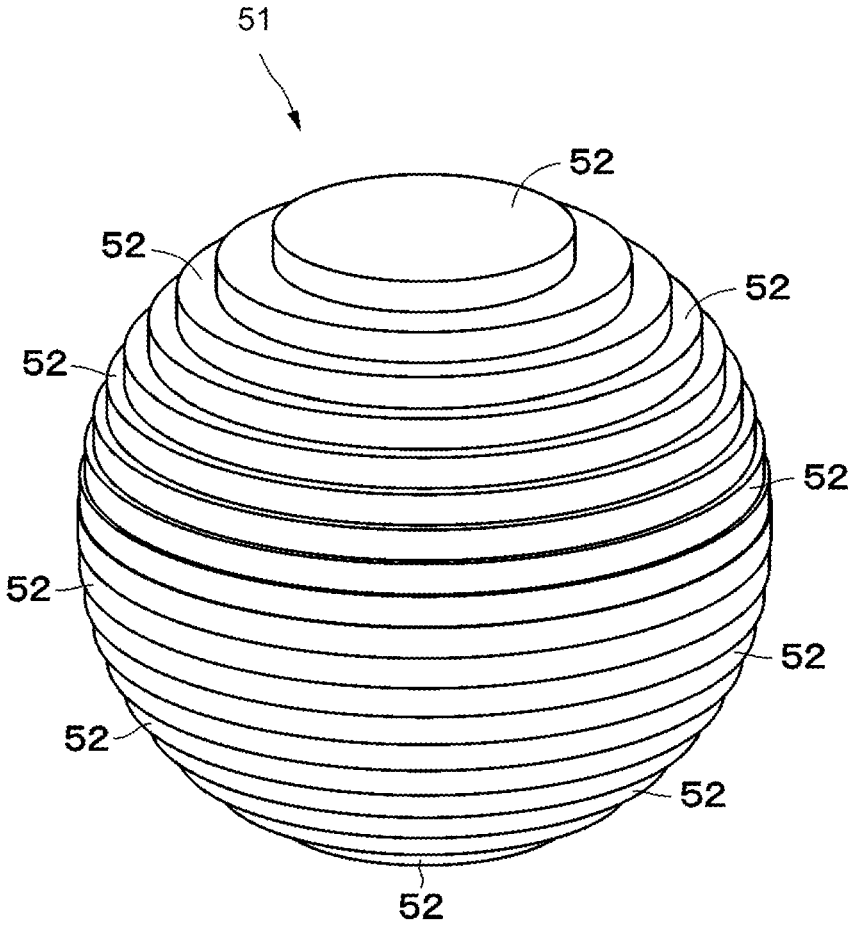
FIG. 17 is a perspective view that illustrates a dielectric lens according to a third variation.

Moreover, in the above-described first embodiment, the dielectric lens 2 has a cylindrical shape formed by the laminate of the disc members 3 having the same outer diameter dimension. The present disclosure is not limited to this example. As in a third variation illustrated in FIG. 17, for example, a plurality of disc members 52 similar to the disc members 3 may be formed with different outer diameter dimensions. The laminate of the plurality of disc members 52 with different outer diameter dimensions can form a spherical dielectric lens 51. This configuration is also applicable to the second embodiment.

The above-described embodiments are illustrated as examples, and the configurations illustrated in different embodiments may be replaced in part or combined.

Next, the disclosure included in the above-described embodiments is described. The present disclosure is a dielectric lens formed of a laminate of a plurality of disc members having distribution of permittivity varying with respect to the radial direction. Each of the disc members includes a planar section in which the thickness dimension of a radially outer area is smaller than that of a radially inner area and fin sections extending in a radial manner from the central portion of the planar section toward the radially outer side. In each of the fin sections, the radially inner area and radially outer area have the same thickness dimension.

In this configuration, when the plurality of disc members are laminated, the fin sections can form gaps in the radially outer area. The dimension of each of the gaps with respect to the thickness direction in the radially outer area is larger than that in the radially inner area. Consequently, because the effective permittivity on the radially outer side is lower than that on the radially inner side, the dielectric lens formed of the laminate of the plurality of disc members operates as a Luneburg lens. The disc members do not need to have many holes, and they can be easily formed by injection molding. Thus, the mass-productivity of the dielectric lenses can be enhanced.

In the present disclosure, each of the fin sections include a plurality of depressions positioned between the center and outer edge in the radial direction and having smaller thickness dimensions and a plurality of projections positioned other than the depressions and having larger thickness dimensions. The length dimension of each of the depressions in the radial direction is set at a value smaller than ¼ of the wavelength of a radio wave to be used, and the length dimension of each of the projections in the radial direction is set at a value smaller than ¼ of the wavelength of the radio wave to be used.

In the present disclosure, the fin section includes the plurality of depressions, where are positioned between the center and outer edge in the radial direction and have smaller thickness dimensions, and the plurality of projections, which are positioned other than the depressions and have larger thickness dimensions. This can lead to a reduction in the difference between the effective permittivity of the dielectric lens to a polarized wave parallel with the thickness direction of the disc member and the effective permittivity of the dielectric lens to a polarized wave perpendicular to the thickness direction of the disc member. Consequently, the effective permittivity can obtain desired distribution for not only the polarized wave parallel with the thickness direction of the disc member but also the polarized wave perpendicular to the thickness direction of the disc member. Each of the length dimension of the depression in the radial direction and the length dimension of the projection in the radial direction is set at a value smaller than ¼ of the wavelength of the radio wave to be used. Thus, discontinuity between the depression and projection can be reduced with respect to the radio wave to be used.

In the present disclosure, the plurality of disc members have the same outer diameter dimension and form the cylindrical laminate. Thus, the cylindrical Luneburg lens can be formed.

REFERENCE SIGNS LIST

1, 21 Luneburg lens antenna device (antenna device)
2, 22, 51 dielectric lens

3, 23, 31, 41, 52 disc member
4, 32 planar section
9, 24 fin section
25 depression
26 projection
10 array antenna

The invention claimed is:

1. A dielectric lens comprising:

a laminate of a plurality of disc members, each of the disc members having distribution of permittivity varying with respect to a radial direction thereof, wherein the disc member includes a planar section in which a thickness dimension of a radially outer area is smaller than a thickness dimension of a radially inner area and a fin section which extends in a radial manner from a central portion of the planar section toward a radially outer side and in which a radially inner area has a same thickness dimension with a radially outer area.

2. The dielectric lens according to claim 1, wherein the fin section includes a plurality of depressions positioned between its center and outer edge in the radial direction and a plurality of projections positioned other than the depressions, thickness dimensions of the depressions are smaller than thickness dimensions of the projections, a length dimension of each of the depressions in the radial direction is set at a value smaller than ¼ of a wavelength of a radio wave to be used, and a length dimension of each of the projections in the radial direction is set at a value smaller than ¼ of the wavelength of the radio wave to be used.

3. The dielectric lens according to claim 1, wherein the plurality of disc members have a same outer diameter dimension, and the laminate of the disc members has a cylindrical shape.

* * * * *